United States Patent [19]

Macnabb

[11] 4,353,134

[45] Oct. 12, 1982

[54] UNDERWATER SWIMMING GOGGLES AND MASKS WITH GRAVITY-OPERATED WIPERS

[76] Inventor: Thomas C. Macnabb, 4 Maple Apt. 23, Ste-Anne de Bellevue, Québec H9X 2E4, Canada

[21] Appl. No.: 292,956

[22] Filed: Aug. 14, 1981

[51] Int. Cl.[3] ..... A61F 9/04

[52] U.S. Cl. ..... 2/428; 2/435; 2/438

[58] Field of Search ..... 2/435, 438, 428, 429, 2/430, 8, 9, 10; 15/250.13, 250.18, 250.30, 250.31, 250.35, 250.29

[56] References Cited

U.S. PATENT DOCUMENTS

| | | | |
|---|---|---|---|
| 2,253,538 | 8/1941 | Sirch | 2/435 X |
| 2,737,658 | 3/1956 | Poeder | 15/250.30 X |
| 3,890,647 | 6/1975 | Warncke | 2/438 X |

FOREIGN PATENT DOCUMENTS

| | | | |
|---|---|---|---|
| 542906 | 7/1957 | Canada | 15/250.18 |

*Primary Examiner*—Peter P. Nerbun
*Attorney, Agent, or Firm*—Alan Swabey; Robert Mitchell; Guy Houle

[57] ABSTRACT

The invention is concerned with an improved underwater swimming mask or goggles having a lens with an inner surface, a frame mounting the lens in spaced relationship to a swimmer's eyes and a water-excluding face-fitting skirt peripherally extending from the frame. The improvement comprises wiper means mounted for sweeping movement across a viewing area of the lens and in wiping contact with the lens inner surface, and weight means connected to and displaceable with the wiper means for moving same in response to tilting movements of the mask or goggles when worn by the swimmer during swimming. The tilting movements resulting from the swimmer rotating his head from side to side cause the weight means to be displaced by gravity and to thereby move the wiper means therewith so as to dissipate mist or droplets of water collected on the lens inner surface and to clear the viewing area of the lens.

15 Claims, 11 Drawing Figures

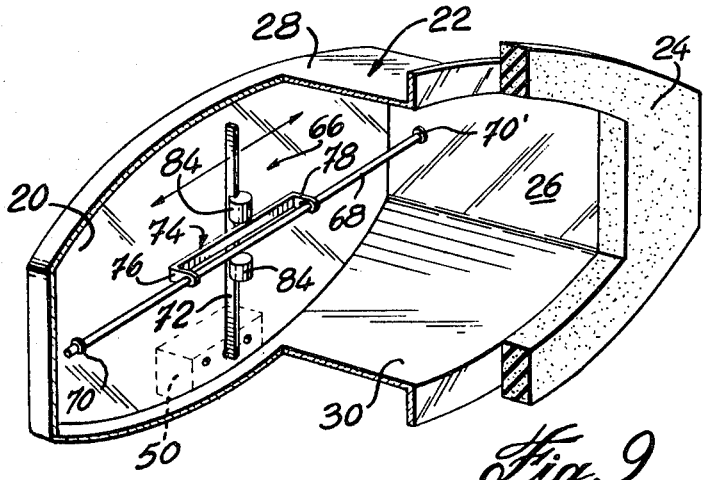
Fig. 9
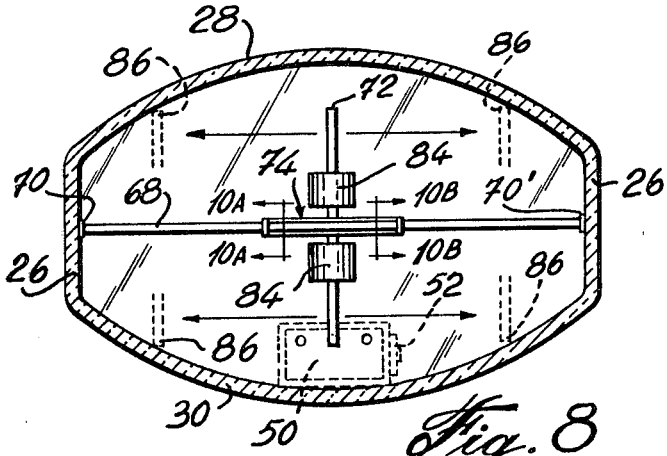
Fig. 8
Fig. 10A
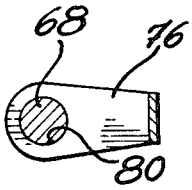
Fig. 10B
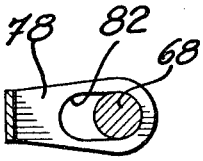

UNDERWATER SWIMMING GOGGLES AND MASKS WITH GRAVITY-OPERATED WIPERS

FIELD OF THE INVENTION

This invention relates to improvements in underwater swimming goggles and masks.

These articles have a lens mounted in a frame having a water-excluding face-fitting skirt peripherally extending therefrom so as to provide a water-free space between the lens and the wearer's eyes. When used for any length of time, water collects on the lens inner surface in the form of mist or small droplets, as a result of water condensation caused by a difference in temperature between the inner and outer surfaces of the lens; this of course impairs the swimmers's view.

SUMMARY OF THE INVENTION

It is an aim of the present invention is to alleviate this problem and to provide an improved underwater swimming mask or goggles having gravity-operated wiper means arranged to dissipate the mist or droplets of water collected on the lens inner surface during swimming.

In accordance with a broad aspect of the invention, there is provided in an underwater swimming mask or goggles having a lens with an inner surface, a frame mounting the lens in spaced relationship to a swimmers's eyes and a water-excluding face-fitting skirt peripherally extending from the frame, the improvement comprising wiper means mounted for sweeping movement across a viewing area of the lens and in wiping contact with the lens inner surface, and weight means connected to and displaceable with the wiper means for moving same in response to tilting movements of the mask or goggles when worn by the swimmer during swimming. The tilting movements resulting from the swimmer rotating his head from side to side cause the weight means to be displaced by gravity and to thereby move the wiper means therewith so as to dissipate mist or droplets of water collected on the lens inner surface and to clear the viewing area of the lens.

According a preferred embodiment of the invention, the wiper means comprises a pair of closely spaced-apart elongated members disposed in fixed relation to one another and pivotally mounted for pivotal movement in a plane parallel to the plane of the lens. In combination with this arrangement, the wiper members may be whisker elements of substantially circular cross-section each fixed at one end thereof to a pivotal holder element, the wisker elements converging towards one another at their free ends; the holder element also serves to carry the weight means on an arm fixed thereto and spaced from the lens inner surface with the whisker elements therebetween.

In another preferred arrangement, the wiper members are blade elements each connected to a stationary holder element by means of a flexible connection allowing for pivotal movement of the blade element, the blade elements converging towards one another at their free ends and the weight means being mounted thereon adjacent the free ends.

In still another preferred form of the invention, the wiper means and weight means are slidably mounted on an elongated guide member which extends from side to side of the lens so as to reciprocate across the viewing area of the lens. In this form of the invention, the wiper means and weight may be mounted on a holder element having a pair of spaced-apart arms provided with respective eyelet openings for slidably receiving the guide member, desirably, with one of the eyelet openings being large enough to allow play on the guide member and to thereby permit the wiper means to find its own level against the lens.

The type of underwater swim masks or goggles with which the present invention is concerned should not be confused with spectacles or goggles which are not for underwater use and, in connection with which, various miniaturized "windshield wiper" mechanisms have been disclosed, some manually operated, others run by small electric motors, and others using a flushing arrangement.

BRIEF DESCRIPTION OF THE DRAWINGS

Preferred embodiments of the invention will now be described in greater details with reference to the accompanying drawings, in which.

FIG. 8 is a fragmentary rear sectional view of a third preferred embodiment according to the invention FIG. 9 is an enlarged fragmentary rear perspective view partly in section of the embodiment of FIG. 8; and FIGS. 10A and 10B are enlarged sectional views along lines 10A—10A and 10B—10B of FIG. 8, respectively.

DESCRIPTION OF PREFERRED EMBODIMENTS

Figure 1:
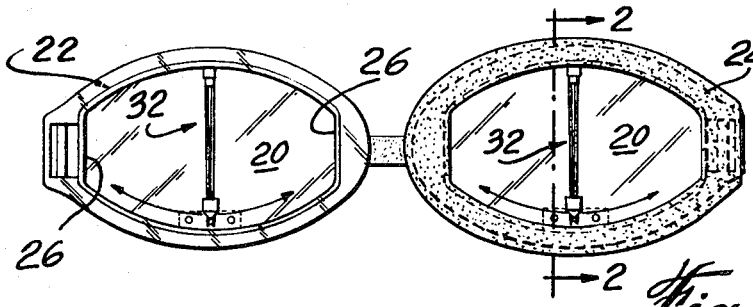
FIG. 1 is a fragmentary rear elevation view of a pair of goggles according to a first preferred embodiment of the invention.
Figure 3:
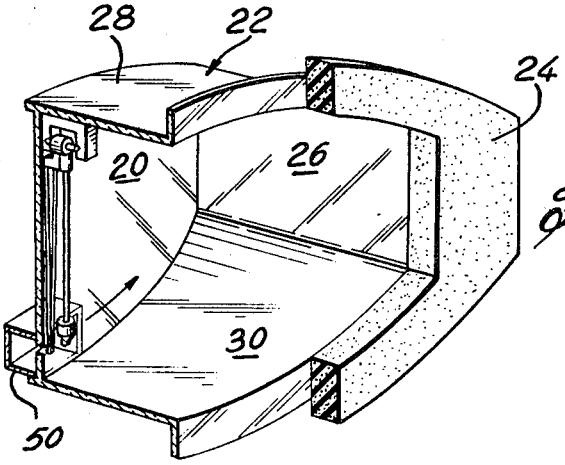
FIG. 3 is an enlarged fragmentary rear perspective view partly in section of the embodiment of FIGS. 1 and 2.

Referring to FIGS. 1 to 4, the pair of goggles illustrated are seen to be each made up of a transparent lens 20 integrally mounted in a frame 22 having a water-excluding face-fitting cushioned skirt 24 peripherally extending therefrom so as to provide a water-free space between the lens and the face of the wearer when swimming. The frame 22 is somewhat oval in shape with planar side walls 26, convex top wall 28 and concave bottom wall 30.

Figure 4:
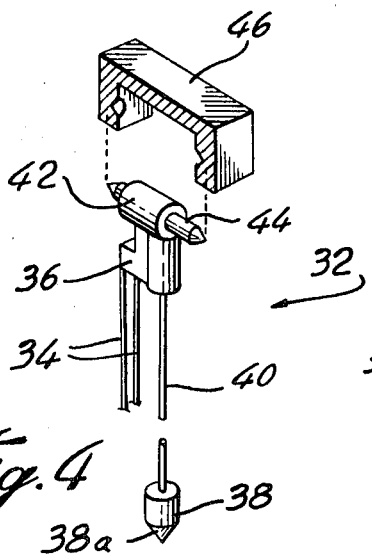
FIG. 4 is a fragmentary exploded view partly in section showing the pivotal mounting of the weighted wiper device used in the embodiment of FIGS. 1 to 3.
Figure 2:
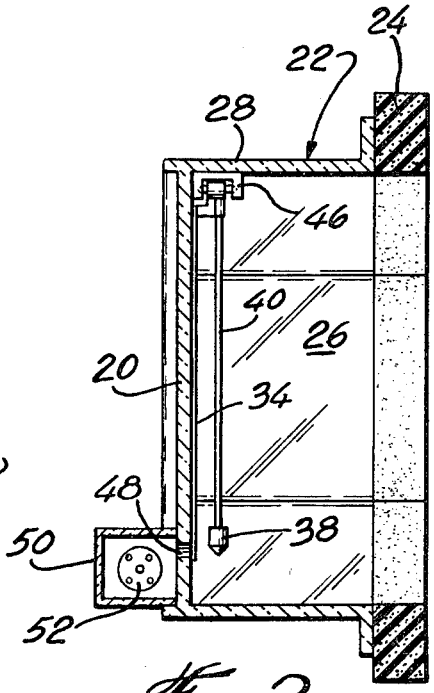
FIG. 2 is a cross-section along the line 2—2 of FIG. 1.

The weighted wiper device generally designated by reference numeral 32 comprises a pair of closely spaced-apart elongated members 34 each fixed at one end thereof to a holder 36 which also carries a weight 38 fixed at the extremity of the supporting arm 40 connected to the holder. In this embodiment, the wiper members 34 take the form of whiskers of circular cross-section, which are held by the holder in such a manner that they converge towards one another at their free ends but do not touch. The holder 36 is secured to a hub 42 mounted on a pivot pin 44 having conical ends and journalled in corresponding conical bearings in the bracket 46, as best shown in FIG. 4. The bracket is fixed to the frame inner top wall 28 against the lens inner surface and centrally thereof so that the whiskers 34 are in wiping contact with the lens inner surface and may sweep in an arc thereacross. The hub 42 is provided with an axial bore which receives the pivot pin 44 in frictional fit engagement so that it can be adjustably displaced axially on the pivot pin and thereby permit the whiskers 34 to be set in contact with or just clearing the surface of the lens 20.

In operation, as the swimmer moves his head from side to side, in a plane approaching the vertical, gravity causes the weight 38 to remain substantially in a vertical plane retaining with it the whiskers 34 so that the lens is moved back and forth relative to the whiskers. The whiskers in their strokes across the lens encounter the mist or droplets of water causing them to coalesce. The surface tension of the water causes it to agglomerate between the two whiskers 34. The slow migration of the water by gravity towards the outer ends is assisted by the taper between the whiskers 34. As the whiskers pass over three drain holes 48 provided in the lens 20 adjacent the bottom thereof, the water at the outer ends of the whiskers migrates through the holes into the reservoir 50. The water collected in the reservoir is removed by blowing into the goggle, which forces the water through a one-way valve 52 provided on one end of the reservoir 50.

Both the whiskers 34 and the counter-weight arm 40 travel through an arc and are limited in movement by impinging on the side walls 26 of the frame. To this end, the weight 38 may be chamfered at its outer end, as at 38*a*, so that the wiper whiskers contact the side walls just as the weight is stopped by the frame. The weight 38 should of course be sufficient to overcome the friction of the whiskers 34 against the lens 20, yet not too heavy to result in a jamming condition of the whiskers against the lens.

In construction, the whiskers 34 may be made of plastic and have a diameter of, for example, about 0.55 mm; they may be spaced-apart, for example, about 0.80 mm at the point of fixture with the holder 36 and about 0.50 mm at their free ends, the distance between said dimensions being 21.5 mm.

Figure 5:
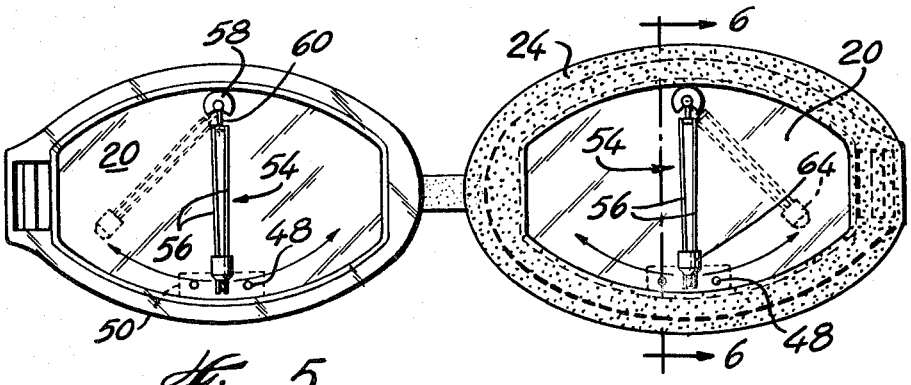
FIG. 5 is a fragmentary rear elevation view of a pair of goggles according to a second preferred embodiment of the invention.
Figure 6:
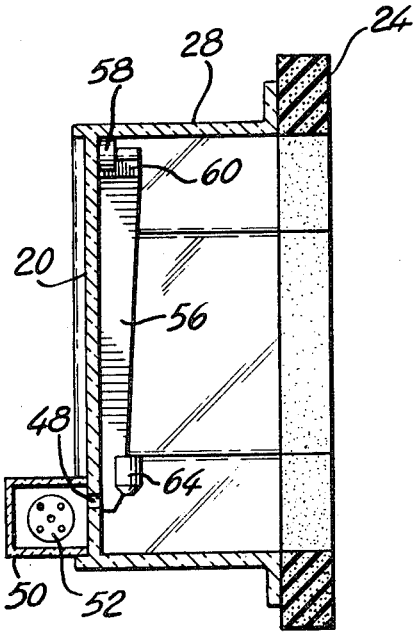
FIG. 6 is a cross-section along the line 6—6 of FIG. 5.
Figure 7:
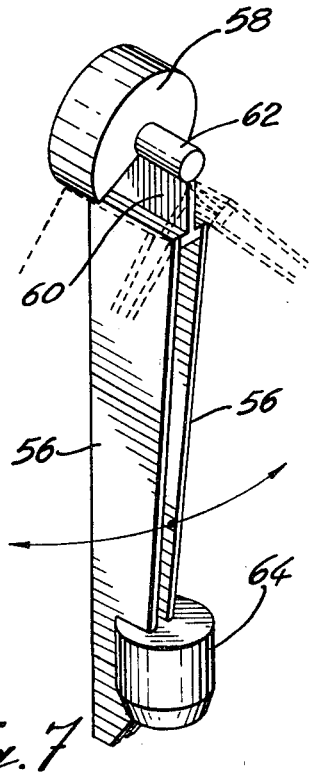
FIG. 7 is an enlarged fragmentary rear perspective view of the embodiment of FIGS. 5 and 6 showing particularly the weighted wiper device.

An alternative embodiment is shown in FIGS. 5 through 7.

The weighted wiper device 54 of this embodiment comprises a pair of closely spaced-apart blades 56 each connected at one end thereof to a stationary holder 58 by means of a flexible connection in the form of a web 60 which allows for pivotal movement of the blades 56. The flexible web 60 has parallel edges, one edge being integrally connected to an anchor member 62 which is moulded integrally with the stationary holder 58 and the other edge secured to the ends of the blades 56. The holder 58 is fixed to the lens inner surface against the frame top inner wall 28 and centrally of the lens so that the blades 56 are in wiping contact with the lens inner surface and may sweep in an arc thereacross. The blades converge towards one another at their free ends. A weight 64 is mounted on the blades adjacent their free ends and interconnects same.

In construction, the blades 56 may be made of plastic and be spaced apart, for example, about 0.80 mm adjacent their connection to the web 60 and converge to about 0.50 mm apart at their extremities, the distance between said dimensions being 21.5 mm. The weight 64 is mounted on the blades with the function of overcoming the friction of the blades 56 with the surface of the lens 20.

As in the form of device described earlier, in operation the weight 64 tends to keep the blades 56 in the vertical plane while the lens 20 is moved back and forth by the movements of the head of the swimmer, so that the blades sweep back and forth relative to the lens.

Water droplets will agglomerate between the blades 56 and will migrate by gravity to their outer extremities where they will escape through the drain holes 48 and collect into the reservoir 50.

A further embodiment is shown in FIGS. 8 to 10.

In this embodiment, the weighted wiper device 66 is slidably mounted on a guide rod 68 extending from side to side of the lens 20, for reciprocating sweeping movement across the viewing area of the lens. The ends of the rod 68 are fixed to the frame side walls 26 at points 70 and 70'; rod 68 extends parallely to the surface of the lens and is located midway between the frame top and bottom walls 28 and 30.

The device 66 comprises a wiper blade 72 fixedly mounted on an elongated bracket 74 having a pair of spaced-apart arms 76 and 78 provided with respective eyelet openings 80 and 82 for slidably receiving the rod 68; arms 76 and 78 extend perpendicularly to the elongate portion of the bracket 74. A pair of weight elements 84 are mounted on the blade 72 with the bracket 74 disposed therebetween.

The movement of the wiper blade 72 is constrained by the bracket 74 to which it is rigidly fixed. As the blade 72 reaches the extremity of its lateral movement, the upper and lower ends of the blade touch the top and bottom walls 28 and 30 of the frame at points 86 concurrent with its limit of travel, the arms 76 and 78 of the bracket 74 simultaneously touching the side walls 26 at points 70 and 70' thus preventing the wiper blade from jamming at the points 86.

The wiper blade 72 is held in wiping contact against the surface of the lens 20 by its own weight, augmented by the weights 84. Any vertical eccentricity between the wiper blade 72 and the guide rod 68 is taken up by play facilitated by an elongation of the eyelet opening 82, as best shown in FIG. 10B.

The operation is similar to that of the earlier described embodiments. As the swimmer rocks his head, gravity will tend to cause the weights 84 to sweep the wiper blade 72 across the viewing area of the lens 20.

I claim:

1. In an underwater swimming mask or goggles having a lens with an inner surface, a frame mounting said lens in spaced relationship to a swimmer's eye and a water-excluding face-fitting skirt peripherally extending from said frame, the improvement comprising:

wiper means mounted for sweeping movement across a viewing area of said lens and in wiping contact with said lens inner surface, and weight means connected to and displaceable with said wiper means for moving same in response to tilting movements of said mask or goggles when worn by the swimmer during swimming, whereby said tilting movements cause said weight means to be displaced by gravity and to thereby move said wiper means therewith so as to dissipate mist or droplets of water collected on said lens inner surface and to clear said viewing area.

2. An underwater swimming mask or goggles as claimed in claim 1, wherein said wiper means comprises a pair of closely spaced-apart elongated members disposed in fixed relation to one another and pivotally mounted for pivotal movement in a plane parallel to the plane of said lens.

3. An underwater swimming mask or goggles as claimed in claim 2, wherein said wiper members are whisker elements of substantially circular cross-section each fixed at one end thereof to a pivotal holder element, said wisker elements converging towards one another at their free ends.

4. An underwater swimming mask or goggles as claimed in claim 3, wherein said holder element is pivotally mounted adjacent a top edge of said lens and centrally thereof.

5. An underwater swimming mask or goggles as claimed in claim 4, wherein said holder element has a hub including a bore which receives in frictional fit engagement a pivot pin extending perpendicularly to said lens, whereby said hub is displaceable along said pivot pin so as to permit said whisker elements to be adjustably positioned relative to the lens inner surface.

6. An underwater swimming mask or goggles as claimed in claims 3, 4 or 5, wherein said weight means comprises a weight element mounted on an arm fixed to said holder element, said arm being spaced from the lens inner surface with said whisker elements therebetween, said weight element on said arm being remote from said holder element.

7. An underwater swimming mask or goggles as claimed in claim 2, wherein said wiper members are blade elements each connected at one end thereof to a stationary holder element by means of a flexible connection allowing for pivotal movement of said blade elements, said blade elements converging towards one another at their free ends.

8. An underwater swimming mask or goggles as claimed in claim 7, wherein said holder element is fixedly mounted adjacent a top edge of said lens and centrally thereof.

9. An underwater swimming mask or goggles as claimed in claim 8, wherein said flexible connection comprises a flexible web having parallel edges, one of said edge being fixed to an anchor member on said holder element and the other edge secured to said one ends of said blade elements.

10. An underwater swimming mask or goggles as claimed in claims 7, 8 or 9, wherein said weight means comprises a weight element mounted on said blade elements adjacent their free ends.

11. An underwater swimming mask or goggles as claimed in claim 1, wherein said wiper means comprises a blade element slidably mounted on an elongated guide member extending from side-to-side of said lens, for reciprocating sweeping movement across the viewing area of said lens.

12. An underwater swimming mask or goggles as claimed in claim 11, wherein said blade element is mounted on a holder element having a pair of spaced-apart arms provided with respective eyelet openings for slidably receiving said guide member, one of said eyelet openings being adapted to allow play on said guide member.

13. An underwater swimming mask or goggles as claimed in claims 11 or 12, wherein said weight means comprises a pair of weight elements mounted on said blade element with said guide member extending therebetween.

14. An underwater swimming mask or goggles as claimed in claim 1, including a reservoir mounted to an outer surface of said lens adjacent a bottom edge thereof, said lens being provided with at least one aperture disposed in the sweeping path of said wiper means and allowing water dissipated by said wiper means to collect into said reservoir.

15. An underwater swimming mask or goggles as claimed in claim 14, wherein said reservoir is provided with one-way valve means responsive to a predetermined pressure in said reservoir to allow the collected water to escape therefrom.

* * * * *